US007567772B2

(12) United States Patent
Shiraishi

(10) Patent No.: US 7,567,772 B2
(45) Date of Patent: Jul. 28, 2009

(54) COLOR PRINTER APPARATUS

(75) Inventor: Takashi Shiraishi, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 169 days.

(21) Appl. No.: 11/456,340

(22) Filed: Jul. 10, 2006

(65) Prior Publication Data

US 2008/0008500 A1 Jan. 10, 2008

(51) Int. Cl.
*G03G 15/01* (2006.01)
*G03G 15/00* (2006.01)
*G03G 15/04* (2006.01)

(52) U.S. Cl. ..... 399/223; 399/118; 399/119

(58) Field of Classification Search ..... 399/201, 399/202, 223, 299, 300, 302, 303, 107, 118, 399/119

See application file for complete search history.

(56) References Cited

U.S. PATENT DOCUMENTS

2001/0021322 A1 * 9/2001 Tsuruya et al. ..... 399/223

FOREIGN PATENT DOCUMENTS

JP 2001-296715 10/2001
JP 2005-221870 8/2005

* cited by examiner

*Primary Examiner*—Hoang Ngo
(74) *Attorney, Agent, or Firm*—Turocy & Watson, LLP

(57) ABSTRACT

By using an embodiment of the invention, an image forming apparatus capable of reducing time required until an image output of a single color frequently used for image formation is outputted and capable of increasing a toner volume used for the image output of the single color frequently used for image formation is obtained.

13 Claims, 4 Drawing Sheets

COLOR PRINTER APPARATUS

BACKGROUND OF THE INVENTION

1. Field of the Invention

The present invention relates to an image forming apparatus represented by, for example, an electrostatic copying machine and a laser beam printer, and, more particularly to a color image forming apparatus capable of providing a color image on the basis of a subtractive process.

2. Description of the Related Art

A color image forming apparatus capable of providing a color image on the basis of a subtractive process has already been put to practical use and widely used.

In Japanese Patent Disclosure (KOKAI) No. 2005-221870 or Japanese Patent Disclosure (KOKAI) No. 2001-296715, an image forming apparatus in which developing units that provide images of respective colors of yellow (Y), magenta (M), and Cyan (C) and a developing unit that provides an image of Black (BK) are arranged in one row along a transfer belt is described.

However, in the image forming apparatus described in the two publications, when, in order to increase a toner volume of a developing unit for a specific color, for example, BK, an interval between the BK developing unit and a developing unit of a color adjacent to the BK developing unit is set wider than intervals among the developing units of the other colors, a distance from an exposing unit to an imaging plane (a photosensitive drum on which an image to be transferred onto the transfer belt is formed) changes, making it difficult to design the exposing unit.

BRIEF SUMMARY OF THE INVENTION

It is an object of the invention to provide an image forming apparatus that can increase a toner volume used for image output of a single color frequently used for image formation.

The invention provides an image forming apparatus comprising:

a first toner image generating unit that generates a latent image corresponding to first image light supplied in association with one of color components;

a second toner image generating unit that generates a latent image corresponding to second image light supplied in association with one of the color components different from the first image light supplied to the first toner image generating unit;

an exposing unit that (continuously) deflects the first image light and the second image light in one direction toward the first and the second toner image generating units, respectively;

a first developing unit that is located in an area further on an outer side than a space defined by the first image light supplied to the first toner image generating unit and the second image light supplied to the second toner image generating unit by the exposing unit, respectively, and visualizes, with a toner of a first color, a latent image formed on the first toner image generating unit by the first image light; and a second developing unit that is located in an area further on an inner side than a space defined by the first image light supplied to the first toner image generating unit and the second image light supplied to the second toner image generating unit by the exposing unit, respectively, and visualizes, with a toner of a second color, a latent image formed on the second toner image generating unit by the second image light.

Advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

(FIG. 2 shows a state in which image light deflected by a deflecting unit is cut in a position where an optical path length of the image light is the smallest; and FIG. 3 shows a state in which image light is deflected by the deflecting unit);

DETAILED DESCRIPTION OF THE INVENTION

An embodiment of the invention will be hereinafter explained with reference to the drawings.

Figure 1:
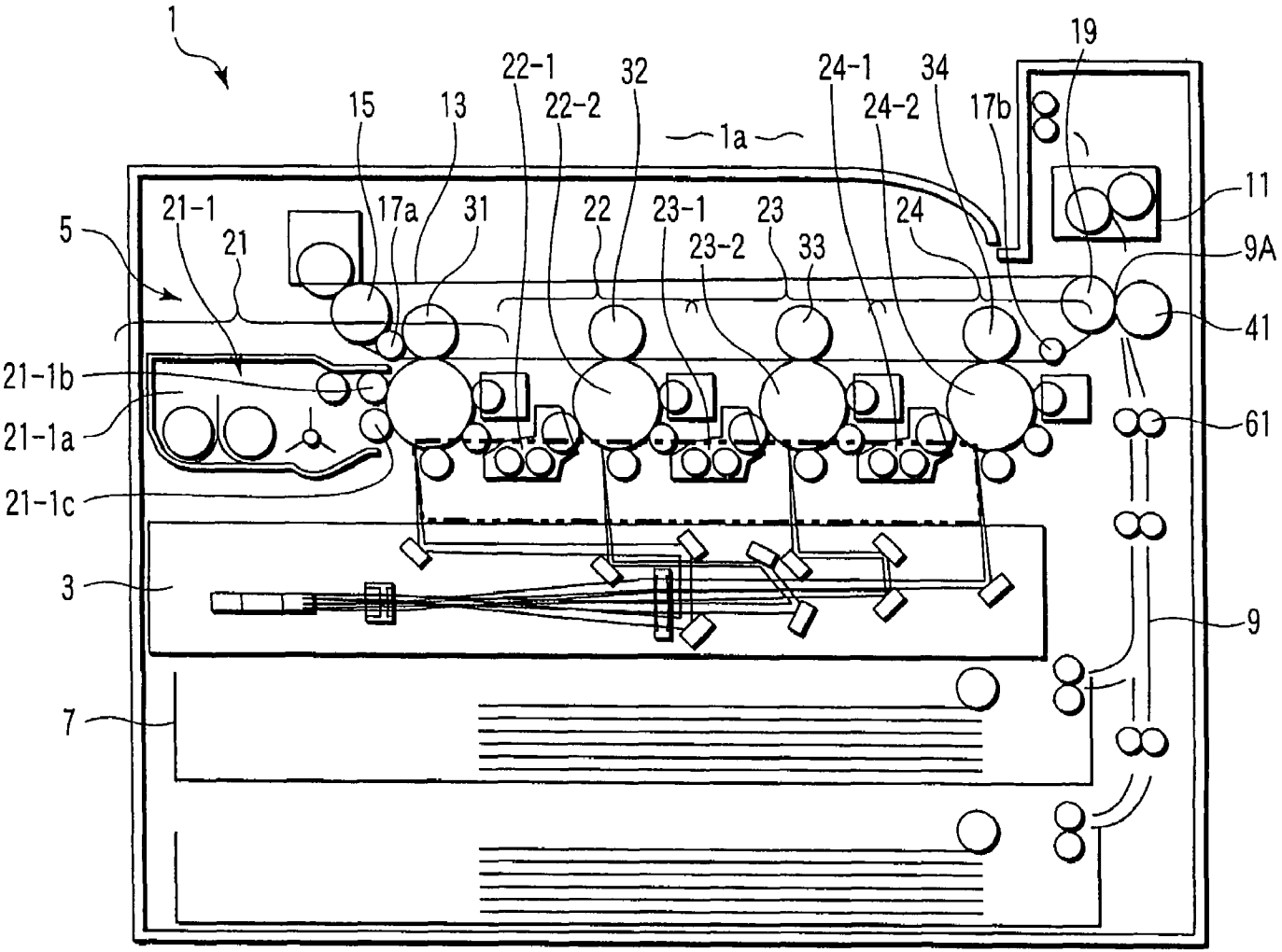
FIG. 1 is a schematic diagram showing an example of an image forming apparatus to which an embodiment of the invention is applied.

FIG. 1 shows an example of an image forming apparatus including an optical scanning unit (an exposing unit) to which the embodiment of the invention is applied. In the explanation of the embodiment, an example of the invention will be explained with a color printer apparatus as an example. However, it goes without saying that the invention is applicable to an arbitrary apparatus (capable of outputting an image) such as a full-color copying apparatus, a facsimile apparatus, or a workstation apparatus.

The image forming apparatus, that is, a color printer apparatus 1 includes an exposing unit 3 that generates image light corresponding to an image signal and an image forming unit 5 that transfers, on the basis of image light supplied by the exposing unit 3, a toner image visualized by a developing agent, that is, a toner onto a transfer medium, that is, sheet-like paper P used for an output (output paper) called hard copy or print out and outputs the output.

Paper is provided to the image forming unit 5, every time a toner image is formed, from a paper holding unit 7 capable of holding an arbitrary number of pieces of the sheet-like paper P of a predetermined size and providing the paper P one by one according to timing when the toner image is formed in the image forming unit 5.

A conveyance path 9 that guides the paper P from the paper holding unit 7 toward the image forming unit 5 is provided between the paper holding unit 7 and the image forming unit 5. The conveyance path 9 guides the paper P to a fixing unit 11, which fixes a toner image transferred onto the paper P on the paper P as explained later, through a transfer position 9A where a toner image formed in the image forming unit 5 is transferred as explained later. The conveyance path 9 also functions as a paper passage that guides the paper P having the toner image fixed thereon by the fixing unit 11 to an image output holding unit 1*a* also serving as a part of a cover over the image forming unit 5.

The image forming unit 5 has an intermediate transfer belt 13 obtained by forming, for example, an insulative film of predetermined thickness in an endless belt shape. A belt obtained by forming metal in a thin sheet shape and protecting the surface of the metal with resin or the like can also be used as the intermediate transfer belt 13.

Predetermined tension is given to the intermediate transfer belt 13 by a driving roller 15, a first tension roller 17*a* and a second tension roller 17*b*, and a transfer roller 19. When the driving roller 15 is rotated, an arbitrary position parallel to an axis of the driving roller 15 is moved in a direction of an arrow A. In other words, a belt surface of the intermediate transfer belt 13 is turned in one direction at speed at which the outer peripheral surface of the driving roller 15 is moved.

First, second, third, and fourth image forming units 21, 22, 23, and 24 are arranged at predetermined intervals in a section where the belt surface of the intermediate transfer belt 13 is moved substantially flatly in a state in which the predetermined tension is given to the intermediate transfer belt 13 by the respective rollers. In the example shown in FIG. 1, the first image forming unit 21 is located on the side of the first tension roller 17*a* and the fourth image forming unit 24 is located on the side of the second tension roller 17*b* in a section where the belt surface of the intermediate transfer belt 13 is moved substantially flatly between the first tension roller 17*a* and the second tension roller 17*b*.

The respective first to fourth image forming units 21 to 24 include at least developing units 21-1, 22-1, 23-1, and 24-1 in which toners of arbitrary colors of a BK (Black), C (Cyan), M (Magenta), and Y (Yellow) are stored and photosensitive drums 21-2, 22-2, 23-2, and 24-2 that hold electrostatic images that the respective developing units should develop. Electrostatic images (latent images) corresponding to images of colors that the developing units set in the image forming units should develop are formed on the surfaces (the outer peripheral surfaces) of the photosensitive drums of the respective image forming units by image light from the exposing unit 3. Consequently, the toners are selectively supplied the corresponding developing units. As a result, developing agent images, that is, toner images of the colors defined in advance are formed on the respective photosensitive drums.

In the printer apparatus 1 shown in FIG. 1, the BK developing unit storing the toner of BK is arranged closest to the first tension roller 17*a* (the developing unit 21-1 corresponds to the BK developing unit). One of characteristics provided by the arrangement of the BK developing unit 21-1 is that the developing unit is located in a space on the outer side of a space, a frame indicated by a dotted line in the figure, in which image lights provided by the exposing unit 3 are guided to the respective image forming units 21 to 24. In this case, a combination of the colors (of toners) allocated to the second to the fourth image forming units 22 to 24 other than the BK developing unit 21-1 (an order of arrangement of the units) is arbitrary.

Transfer rollers 31 to 34 for transferring toner images held by the respective photosensitive drums to the intermediate transfer belt 13 are provided in positions opposed to the respective photosensitive drums on the rear surface side of the intermediate transfer belt 13 in a state in which the intermediate transfer belt 13 is interposed between the respective photosensitive drums and the respective first to fourth image forming units 21 to 24.

In the printer apparatus 1 in which the developing units 21-1, 22-1, 23-1, and 24-1, the photosensitive drums 21-2, 22-2, 23-2, and 24-2, the transfer rollers 31 to 34, and the intermediate transfer roller 13 are arranged as described above, image lights, which are generated when image signals supplied by a not-shown image signal supplying unit are supplied to the exposing unit 3 for each of the color components, are irradiated on the surfaces of the photosensitive drums integral with the developing units, which hold toners of the corresponding colors, and exposure of the surfaces is performed.

In this case, in the respective image forming units 21 to 24, electrostatic latent images are formed at predetermined timing and developed (visualized) by the developing units corresponding thereto such that toner images that are (should be) sequentially transferred to the intermediate transfer belt 13 are superimposed one on top of another on the intermediate transfer belt 13.

Toner images formed on the photosensitive drums 21-2, 22-2, 23-2, and 24-2 of the respective image forming units 21 to 24 are transferred onto the intermediate transfer belt 13 by the primary transfer units 31 to 34 corresponding to the respective photosensitive drums 21-2, 22-2, 23-2, and 24-2. In this case, when the intermediate transfer belt 13 is turned (moved) at predetermined speed, toner images of BK, C, M, and Y are stacked in order on the intermediate transfer belt 13. As the primary transfer units 31 to 34, in the example in FIG. 1, roller bodies are used. However, naturally, the transfer units 31 to 34 may be voltage generating units such as scorotrons. Further, as explained above, a color of a toner image transferred firstly onto the intermediate transfer belt 13 is BK. However, an order of C, M, and Y other than BK is set arbitrarily.

A (full-color) toner image obtained by superimposing the toner images one on top of another on the intermediate transfer belt 13 is transferred onto the paper P, which is guided to the transfer position 9A, by a transfer unit (a secondary transfer roller) 41 brought into contact with the intermediate transfer belt 13 at a predetermined pressure in the transfer position 9A of the conveyance path 9.

A registration roller 61 that temporarily stops the paper P guided from the paper holding unit 7 toward the transfer position 9A is provided in a predetermined position in the conveyance path 9 from the paper holding unit 7 to the transfer position 9A. In the registration roller 61, at least one of rollers rotates in a predetermined direction and the other roller is pressed against one roller with a predetermined pressure via a not-shown press-contact mechanism.

The paper P guided from the paper holding unit 7 toward the transfer position 9A on the conveyance path 9 is temporarily stopped by the registration roller 61. Consequently, inclination (of the paper P itself with respect to a conveyance direction), which may occur while the paper P is conveyed on the conveyance path 9 from the paper holding unit 7, is corrected.

Timing when the toner image carried toward the transfer position 9A following the movement of the belt surface of the intermediate transfer belt 13 comes to the transfer position 9A and timing when the paper P reaches the transfer position 9A are set according to timing when the registration roller 61 is rotated again, whereby a position of the toner image with respect to the paper P is managed (a position of the toner image on the paper P can be set arbitrarily).

Figure 2:
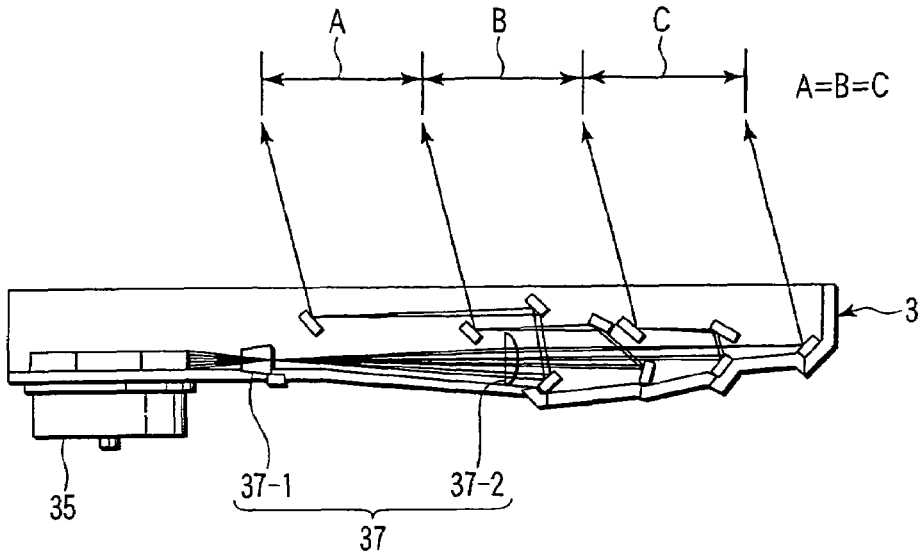
FIGS. 2 and 3 are schematic diagrams showing an example of an exposing unit (an optical scanning unit) built in the image forming apparatus shown in FIG. 1
Figure 3:
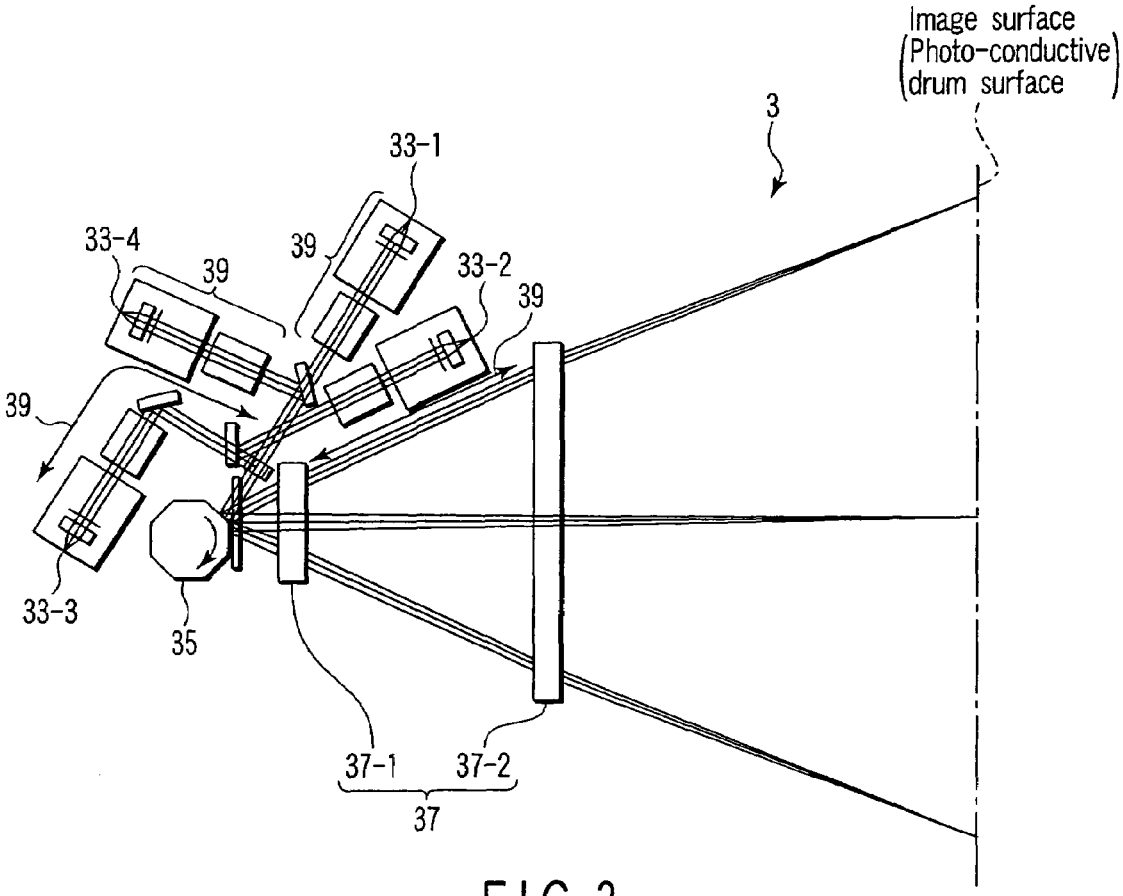

The exposing unit 3 includes, as shown in FIGS. 2 and 3, at least first to fourth light sources (semiconductor laser elements) 33-1 to 33-4 that output image lights (exposure lights) corresponding to image information, which is subjected to color separation in accordance with a subtractive process, used for forming toner images in the respective first to fourth image forming units 21 to 24, a deflecting unit 35 that associates image lights from the respective light sources 33-1 to 33-4 with a raster direction (hereinafter referred to as main-scanning direction) in outputting an output (output paper), an image forming optical system 37 that condenses image lights, which are subjected to raster deflection (scanning) by the deflecting unit 35, on the photosensitive drums 21-2, 22-2, 23-2, and 24-2 of the first to the fourth image forming units 21 to 24 under predetermined conditions regardless of an angle of deflection, and an exposure light shaping optical system 39 that guides image lights from the respective light sources 33-1 to 33-4 to the deflecting unit 35 under predetermined conditions.

The deflecting unit 35 has a rotatable reflection element, which is fixed to a shaft of a motor. The deflecting unit 35 is rotated at predetermined speed (number of revolutions) for the raster scanning (deflection). The number of reflection surfaces provided in the reflection element and the number of revolutions are defined according to a request for output, that is, resolution, output speed, and the like required of the copying apparatus (the image forming apparatus) 1.

The image forming optical system 37 includes, in positions in longitudinal directions of the respective photosensitive drums 21-2, 22-2, 23-2, and 24-2, that is, in a direction perpendicular to a direction in which paper is conveyed (a direction in which the photosensitive drum is rotated), at least (long slender) lenses 37-1 and 37-2 (extending in the longitudinal directions) to which different convergent properties are given in association with positions (on the photosensitive drums) depending on an angle of deflection, which is a swing angle, of image lights subjected to raster scanning by the deflecting unit 35 that is caused when the image light is subjected to raster deflection. The image forming optical system 37 also includes various optical elements (e.g., a mirror(s) and a filter(s)) for guiding the image light subjected to raster scanning by the deflecting unit 35 to the respective photosensitive drums 21-2, 22-2, 23-2, and 24-2 of the first to the fourth image forming units 21 to 24. The lenses 37-1 and/or 37-2 may be replaced with a mirror(s) having a similar curved surface by optimizing types and shapes of the optical elements and using a combination of arrangements.

The exposure light shaping optical system 39 shapes image lights from the respective light sources 33-1 to 33-4 to have a sectional beam shape satisfying predetermined conditions (to be condensed) when the image lights are subjected to raster scanning by the deflecting unit 35 and condensed in a predetermined position in the longitudinal direction of the respective photosensitive drums 21-2, 22-2, 23-2, and 24-2 by the image forming optical system 37. The exposure light shaping optical system 39 includes various optical elements represented by, for example, a condenser(s), a mirror(s), and an aperture stop(s).

Predetermined intervals corresponding to positions where the respective image forming units 21 to 24 are arranged (substantially equal intervals on the belt surface of the intermediate transfer belt 13) are given to image lights emitted from the exposing unit 3. For example, intervals of image lights emitted from the exposing unit 3 are defined as integer times as large as a circumference (a rotation pitch of the driving roller 15) calculated by adding up a diameter of the driving roller 15 and thickness of the intermediate transfer belt 13. This means that, even if there is eccentricity or the like in the driving roller 15, it is possible to make an influence of the eccentricity such as color drift less conspicuous because the same period is given when images are formed in the first to the fourth image forming units 21 to 24.

Figure 4:
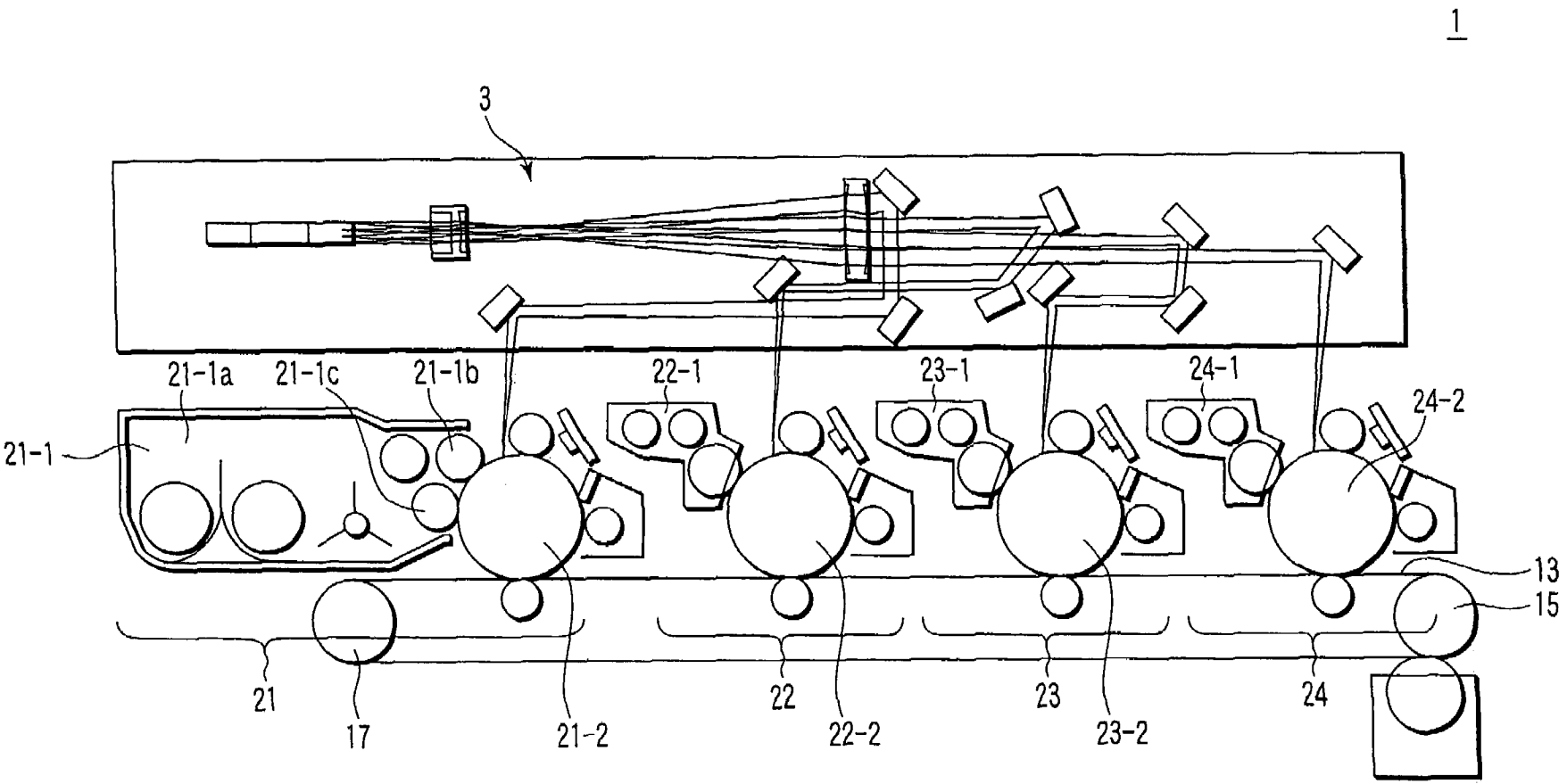
FIG. 4 is a schematic diagram showing an example of a positional relation between a BK developing unit and developing units other than the BK developing unit and an intermediate transfer belt applied to the image forming apparatus shown in FIG. 1.

FIG. 4 shows characteristics in terms of structures of the first developing unit (for BK) and the second to the fourth developing units.

As it is evident from the figure, a capacity of a toner holding space (a toner tank/hopper section) 21-1*a* of the developing unit for BK 21-1 is defined large compared with (e.g., two times or more as large as) that of the second to the fourth developing units 22-1, 23-1, and 24-1. The developing unit for BK 21-1 has first and second developing rollers 21-1*b* and 21-1*c* as developing mechanisms for supplying a developing agent, that is, a toner to an electrostatic image formed on the photosensitive drum 21-2. It goes without saying that only one developing roller may be used instead of the first and the second developing rollers 21-1*b* and 21-1*c*. On the other hand, the developing units of the colors other than BK have a small capacity of the toner holding space (the toner tank/hopper section) 22-1*a* (or 23-1*a* or 24-1*a*) compared with that of the developing unit for BK. The respective developing units are interchangeable (it is sufficient to prepare plural (three sets of) identical developing units and change colors of toners applied to the respective developing units).

When the first developing unit (BK) 21-1 and the second to the fourth developing units 22-1, 23-1, and 24-1 are arranged along a plane area of the intermediate transfer belt 13, a part of the first developing unit 21-1 (e.g., the toner tank/hopper section) projects from the plane area of the intermediate transfer belt 13.

Figure 5:
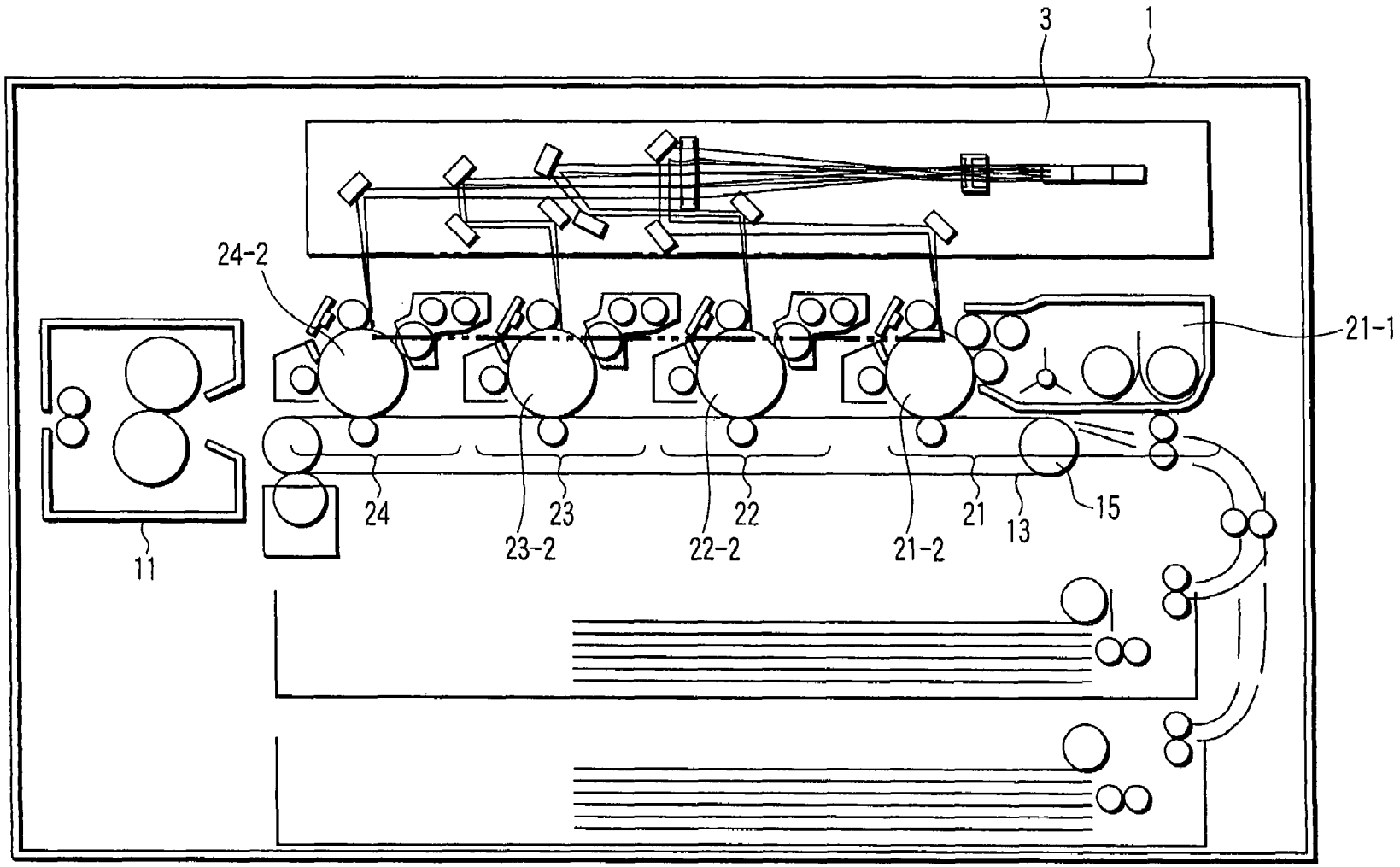
FIG. 5 is a schematic diagram showing an example of an image forming apparatus different from the image forming apparatus shown in FIG. 1.

FIG. 5 shows an example of another embodiment of the printer apparatus shown in FIG. 1. Components substantially identical with those of the printer apparatus shown in FIG. 1 are denoted by the identical reference numerals and detailed explanations of the components are omitted.

A largest difference between the printer apparatus shown in FIG. 5 and the printer apparatus shown in FIG. 1 is that, in the printer apparatus shown in FIG. 5, the first developing unit (for BK) 21-1 is located on a paper supply side (the registration roller 61 side). The printer apparatus shown in FIG. 5 and the printer apparatus shown in FIG. 1 have the same structure in which the second to the fourth developing units 22-1, 23-1, and 24-1 are arranged toward the fixing unit 11 along the direction in which the belt surface of the intermediate transfer belt 13 is moved (turned).

It goes without saying that, in the printer apparatus shown in FIG. 5, the developing unit for BK is located in a space on the outer side of the space in which image lights provided by the exposing unit 3 are guided to the respective image forming units 21 to 24.

As explained above, according to the image forming apparatus of the invention, it is possible to increase a toner volume used for image output of a single color frequently used for image formation.

Advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a first toner image generating unit configured to generate a latent image corresponding to a first image light supplied in association with one of color components;

a second toner image generating unit configured to generate a latent image corresponding to a second image light supplied in association with one of the color components different from the first image light supplied to the first toner image generating unit;

only one exposing unit configured to continuously deflect the first image light and the second image light in one direction toward the first and the second toner image generating units, respectively;

a first developing unit configured to be located in an area further on an outer side than a space defined by the first image light supplied to the first toner image generating unit and the second image light supplied to the second toner image generating unit by the exposing unit, respectively, and visualize, with a toner of a first color, a latent image formed on the first toner image generating unit by the first image light; and a second developing unit which is smaller than the first developing unit and which is configured to be located in an area further on an inner side than a space defined by the first image light supplied to the first toner image generating unit and the second image light supplied to the second toner image generating unit by the exposing unit, respectively, and visualize, with a toner of a second color, a latent image formed on the second toner image generating unit by the second image light.

2. An image forming apparatus according to claim 1, further comprising: a third toner image generating unit configured to generate a latent image corresponding to third image light supplied in association with one of the color components different from both the first image light supplied to the first toner image generating unit and the second image light supplied to the second toner image generating unit, wherein an interval between the first image light and the second image light and an interval between the second image light and the third image light are equal to each other.

3. An image forming apparatus according to claim 1, further comprising: a third developing unit configured to visualize, with a toner of a third color, a latent image formed by the third image light supplied to the third toner image generating unit by the exposing unit.

4. An image forming apparatus according to claim 3, wherein the third developing unit is located in an area on an inner side of a space defined by the first image light supplied to the first toner image generating unit, the second image light supplied to the second toner image generating unit, and the third image light supplied to the third toner image generating unit by the exposing unit, respectively.

5. An image forming apparatus according to claim 4, further comprising: an intermediate transfer member onto which the first to the third toner images obtained by visualizing the latent images, which are generated in the respective first to third toner image generating units, with the first to the third developing units are sequentially transferred.

6. An image forming apparatus according to claim 5, wherein an area defined by arranging the first developing unit, the second developing unit, and the third developing unit is larger than an area in which the intermediate transfer member is arranged along the first to the third developing units.

7. An image forming apparatus according to claim 2, wherein an interval between the first image light and the second image light and an interval between the second image light and the third image light are integer times as large as a circumference calculated by adding up a diameter of a driving mechanism for turning an intermediate transfer belt and thickness of the intermediate transfer belt, respectively.

8. An image forming apparatus according to claim 7, wherein an area defined by arranging the first developing unit, the second developing unit, and the third developing unit is larger than an area in which the intermediate transfer member is arranged along the first to the third developing units.

9. A color image forming apparatus comprising:

a first latent image holding member configured to hold a latent image corresponding to a first image light supplied in association with one of color components;

a second latent image holding member configured to generate a latent image corresponding to a second image light supplied in association with one of the color components different from the first image light supplied to the first latent image holding member;

a third latent image holding member configured to generate a latent image corresponding to a third image light supplied in association with one of the color components different from both the first image light supplied to the first latent image holding member and the second image light supplied to the second latent image holding member;

only one exposing unit configured to continuously deflect the first to the third image lights in one direction, respectively, and cause the first to the third latent image holding members to generate latent images;

a first developing unit configured to be located in an area further on an outer side than a space defined by the first image light supplied to the first latent image holding member, the second image light supplied to the second latent image holding member, and the third image light supplied to the third latent image holding member by the exposing unit, respectively, and the first to the third latent image holding members and visualize, with a toner of a first color, a latent image formed on the first latent image holding member by irradiating the first image light;

a second developing unit which is smaller than the first developing unit and which is configured to be located in an area further on an inner side than the space defined by the first image light supplied to the first latent image holding member, the second image light supplied to the second latent image holding member, and the third image light supplied to the third latent image holding member by the exposing unit, respectively, and the first to the third latent image holding members and visualize, with a toner of a second color, a latent image formed on the second latent image holding member by irradiating the second image light; and a third developing unit which is smaller than the first developing unit and which is configured to be located in an area further on an inner side than a space defined by the first image light supplied to the first latent image holding member, the second image light supplied to the second latent image holding member, and the third image light supplied to the third latent image holding member by the exposing unit, respectively, and the first to the third latent image holding members and visualize, with a toner of a third color, a latent image formed on the third latent image holding member by irradiating the third image light.

10. An image forming apparatus according to claim 9, further comprising: an intermediate transfer member onto which the first to the third toner images independently visualized on the first to the third latent image holding members, respectively, are sequentially transferred.

11. An image forming apparatus according to claim 10, wherein an area defined by arranging the first developing unit, the second developing unit, and the third developing unit is larger than an area in which the intermediate transfer member is arranged along the first to the third developing units.

12. An image forming apparatus according to claim 9, wherein an interval between the first image light and the second image light and an interval between the second image light and the third image light are integer times as large as a circumference calculated by adding up a diameter of a driving mechanism for turning the intermediate transfer belt and thickness of the intermediate transfer belt, respectively.

13. An image forming apparatus according to claim 12, wherein an area defined by arranging the first developing unit, the second developing unit, and the third developing unit is larger than an area in which the intermediate transfer member is arranged along the first to the third developing units.

* * * * *